United States Patent [19]

Kawamura et al.

[11] 4,111,363

[45] Sep. 5, 1978

[54] PORTABLE WATER FOUNTAIN DISPLAY APPARATUS

[76] Inventors: Koichi Kawamura; Yoshiko Kawamura, both of No. 66 Jomyoji, Kamakura, Japan

[21] Appl. No.: 771,379

[22] Filed: Feb. 23, 1977

[30] Foreign Application Priority Data

Feb. 28, 1976 [JP] Japan ..... 51-20616

[51] Int. Cl.[2] ..... B05B 17/08

[52] U.S. Cl. ..... 239/20; 239/17; 40/449; 40/406

[58] Field of Search ..... 239/16, 23, 211, 551, 239/12; 40/28 C, 106.21, 137, 217; 58/1, 2 R

[56] References Cited

U.S. PATENT DOCUMENTS

| | | | |
|---|---|---|---|
| 1,747,377 | 2/1930 | Maxon | 239/18 X |
| 1,762,126 | 6/1930 | Smith | 239/20 X |
| 2,594,877 | 4/1952 | Crockett | 239/18 X |
| 3,635,402 | 1/1972 | Kawamura et al. | 239/18 |
| 3,640,463 | 2/1972 | Kawamura et al. | 239/17 |

*Primary Examiner*—Robert W. Saifer

[57] ABSTRACT

A unit type slanting water fountain display apparatus for displaying time and/or characters on a slopewise display surface. The apparatus is formed as a portable type and is easily moved at a desired site.

7 Claims, 10 Drawing Figures

PORTABLE WATER FOUNTAIN DISPLAY APPARATUS

BACKGROUND OF THE INVENTION

The present invention relates to a portable water fountain display apparatus and more particularly to a slanting display apparatus for displaying characters, numerals or the like in an inclined display surface using water fountains.

A conventional digital water fountain clock apparatus has a horizontal display plane for displaying the clock information so that there is a certain inconvenience in viewing it even if it is installed at a level lower than the ground level. Accordingly it can only be observed from an immediate adjacent location or from a position such as the upper floors of a building standing very close to it. Therefore, the display effect had been restricted since it can not be observed from a distant location. There has been a desire to make such a device so as to be observed from a more distant location. Under such object a three dimensional water fountain display apparatus has been developed.

The applicant had suggested three dimensional display device using water fountain in a prior U.S. Pat. application No. 739,104 filed on Nov. 5, 1976.

Although the above application had disclosed the basic idea of a three dimensional water fountain display apparatus, the device is somewhat bulky and hence not easy to move to other location once installed. Therefore, it has been desired to make it smaller and portable for easy moving.

SUMMARY OF THE INVENTION

A vertical type digital water fountain clock apparatus is realized according to the present invention having the object of miniaturization of the apparatus for easy movement so that it can be installed more flexibly and also simplifying its maintenance and supervision.

BRIEF DESCRIPTION OF THE DRAWINGS

The drawings show an embodiment of the present invention, in which.

DESCRIPTION OF PREFERRED EMBODIMENTS

The invention will now be explained by referring to the accompanied drawings.

Figure 1:
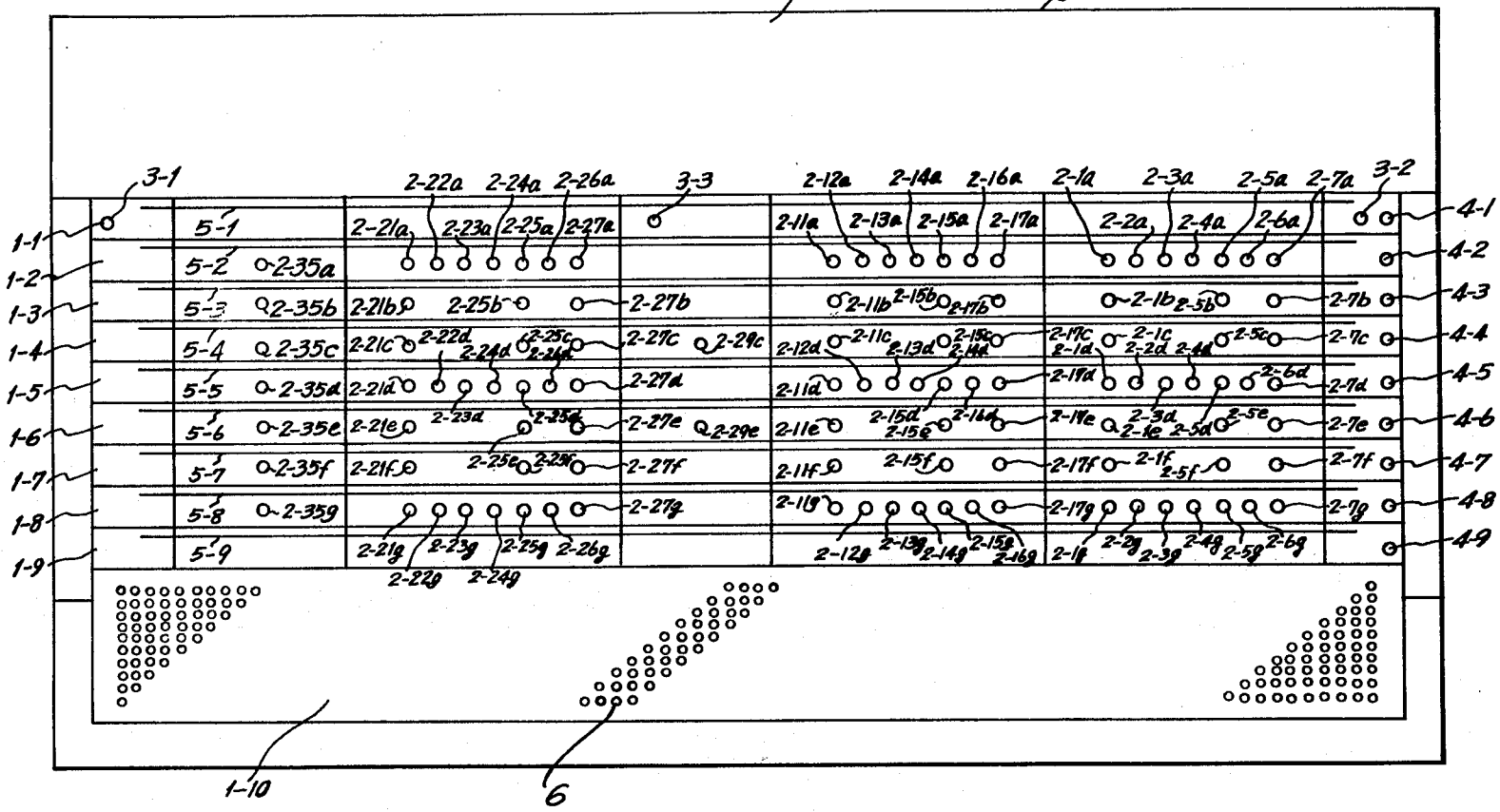
FIG. 1 is a plan view of the apparatus.

FIG. 1 shows a plan view of an embodiment of the present invention. Referring to the same, the frame 1 comprises a housing space 1-11 for housing the electric control device, stepwise ponds 1-1, 1-2, . . . 1-9 and a base pond 1-10. In the stepwise ponds 1-2, . . . 1-8, there are provided display nozzles 2-1*a*, . . . 2–35*g* and in the stepwise pond 1-1, there is provided water supply nozzles 3-1, . . . 3—3. For the drain of the stepwise ponds 1-1, . . . 1-9, drain holes 4-1, . . . 4-9 are provided and they are connected to the base pond 1-10 via plastic tubes.

At each step the ponds 1-1, . . . 1-9, are provided with a ripple preventing plate 5-1, . . . 5-9 respectively having a height slightly higher than the water level of the next adjacent higher pond and a lower edge which extends below the water level in its own pond. On the base pond 1-10 there is a punched metal plate for keeping out the dust coming from outside.

As a preferred embodiment of the present invention, the frame 1 is manufactured from a stainless steel plate. However, steel plate, aluminium plate, copper plate, plastic plate including molded resins such as acrylic resin plate, or wooden plate or the like may be used depending upon the object of the use, site of the use or the desired manufacturing cost and the frame may be formed in various shape from various materials.

In one embodiment of the present invention, time display for 12 hours is made by using display nozzles 2-1*a*, . . . 2-35*g*. However, this is just from the illustration purpose only. By increasing the display nozzles, it is easily possible to display 24 hours information or 12 hours information together with indication of AM or PM.

Figure 2:
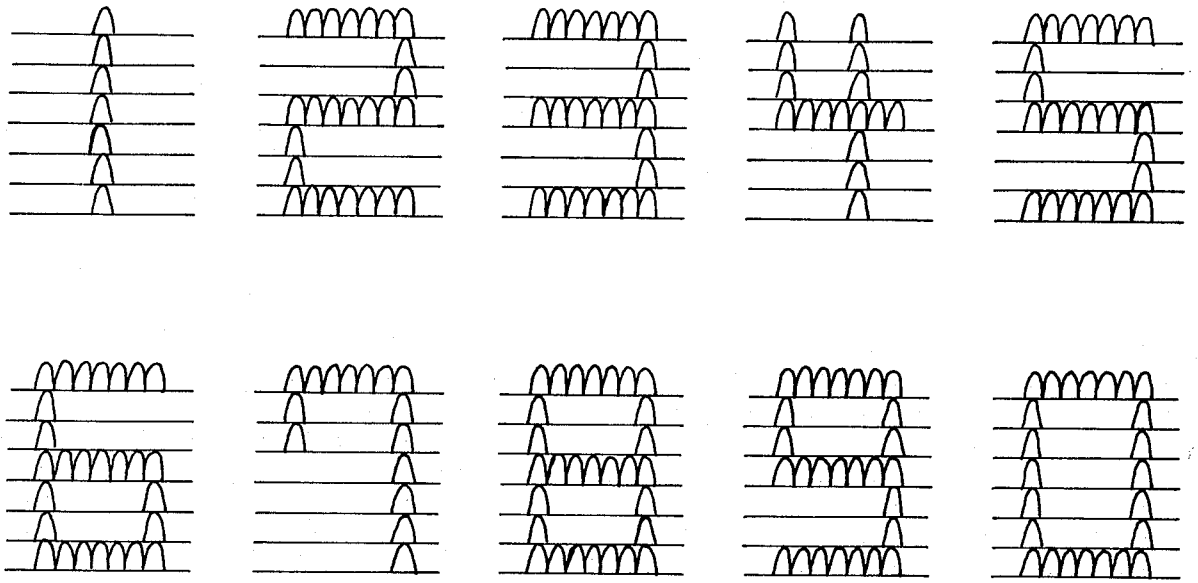
FIG. 2 is a diagrammatic illustration of the display fountain.

FIG. 2 illustrates a water fountain display ejected from selected ones of the display nozzles 2-1*a*, . . . 2-35*g*. The pattern of the display numeral characters is of a rectangular type in the illustrated embodiment. But it can easily be modified to make oblique style or its vertical to horizontal ratio can be modified at will.

Figures 3, 4:
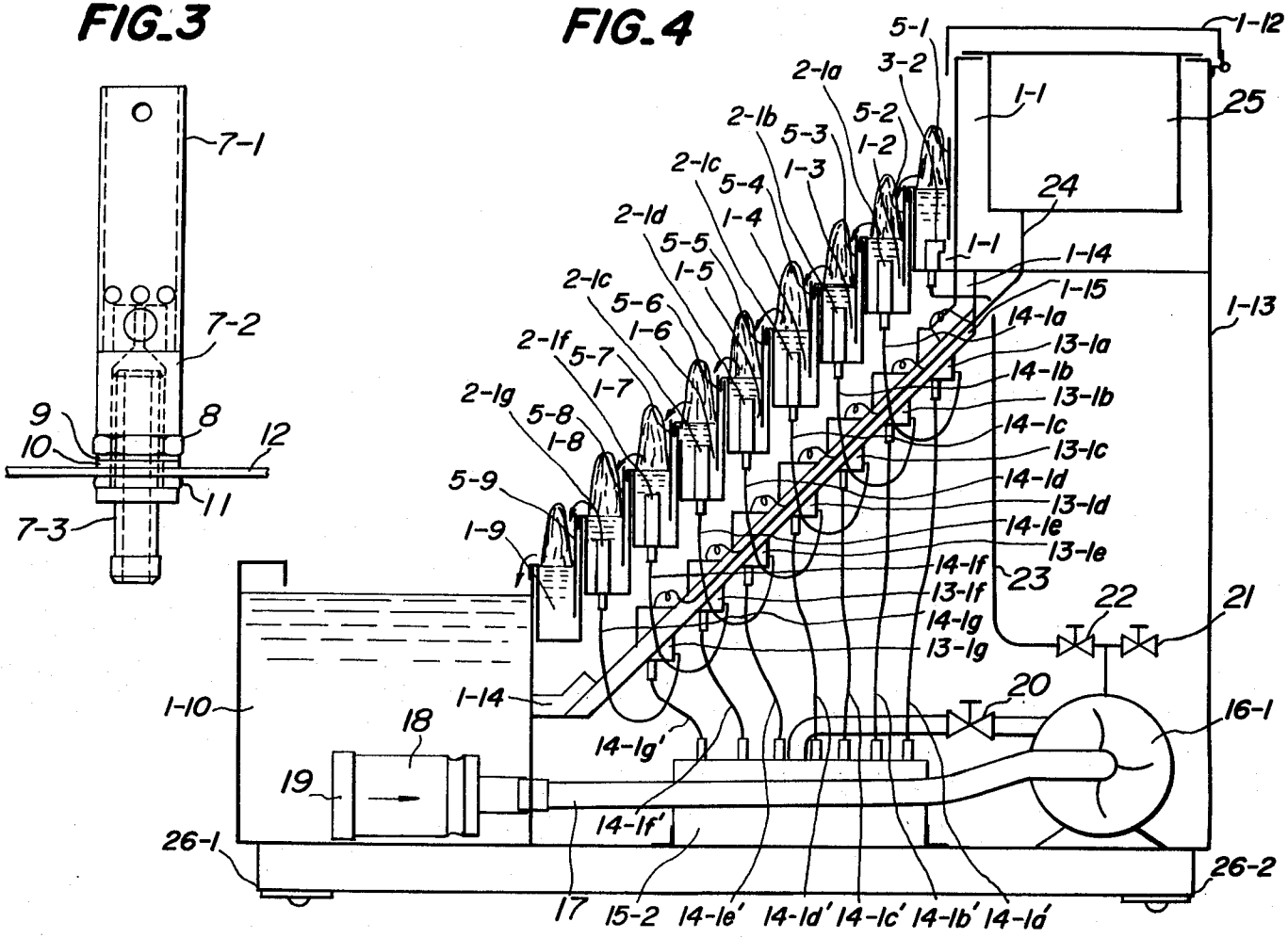
FIG. 3 is an explanatory diagram of a nozzle used for display.
FIG. 4 is a side elevation of the apparatus of the present invention.

The display nozzles 2-1*a*, . . . 2-35*g* are made for instance such as shown in FIG. 3. But various nozzles known per se may be used for this object to obtain the same result. The display nozzles 2-1*a*, . . . 2-35*g* has a stabilizer 7-1 formed integrally with a jet 7-2, to which a mounting box 8 is threaded. In order to avoid leakage of water from the bottom of the pond, a rubber packing or rubber O-ring is inserted between the bottom plate 12 of the pond and a flange shoulder of a mounting boss 7-3 which is secured to the bottom plate 12 of the pond by a nut 8 via a flat washer 10 and a rocking washer 11. To the secured mounting boss 7-3, the nozzle portion having the stabilizer 7-1 and the jet 7-2 formed integrally is threaded on. There is various mounting practice such as to weld the mounting boss 7-3 to the bottom plate 12 of the pond but as such is known, a more detailed explanation is omitted.

The cross-section of the frame is shown in FIG. 4, so that the details may be more readily observed.

Each of the display nozzles 2-1*a*, . . . 2-35*g* mounted in the respective stepwise ponds 1-2, . . . 1-8 is connected to corresponding electromagnetic valves 13-1*a*, . . . 13-35*g* through plastic hoses 14-1*a*, . . . 14-35*g*. The electromagnetic valves 13-1*a*, . . . 13-35*g* are connected to tanks 15-1 and 15-2 through plastic hoses 14-1*a*', . . . 14-35*g*'. The tanks 15-1 and 15-2 are supplied with water from the base pond 1-10 through a water suction tube 17, a suction pump 16-1 and a hand operating valve 20. At the end of the suction tube 17 located in the base pond, there is provided a protecting screen 19 for preventing dust. If the protecting screen 19 is attached directly to the suction tube 17, the suction water quantity at the suction pump 16-1 might become insufficient, so that in the illustrated embodiment a larger diameter pipe 18 having much larger diameter than that of the tube 17 is attached to the tube 17 and the protecting screen 19 is attached to said larger diameter pipe 18 and by this arrangement the pump 16-1 is used efficiently. However, besides such pipe other means can easily be used so as to make the cross-section of suction area larger than the cross-section of the suction tube 17.

The electromagnetic valves 13-1*a*, . . . 13-35*g* are mounted on an electromagnetic valve mounting plate 1-15. The mounting plate 1-15 is in turn mounted on a mounting member 1-14 of the frame. Signal supply wires 24 for the electromagnetic valves 13-1*a*, . . . 13-35*g* are connected to an electric control device 25. Water supply nozzles 3-1 and 3-2 provided in the stepwise pond 1-1 are connected to a feed and drain pump 16-2 through plastic hoses and a manual valve 22. A water supply nozzle 3-3 provided in the stepwise pond 1-1 is connected to a tank 15-1 through a plastic hose. Casters 26-1, . . . 26-6 are attached to the bottom of the frame 11 for providing a good mobile feature of the whole apparatus. The casters 26-1, . . . 26-6 may be dispensed with but by the provision of the same an advantage is obtained in that the whole device may be easily moved by a small number of people.

Figure 5:
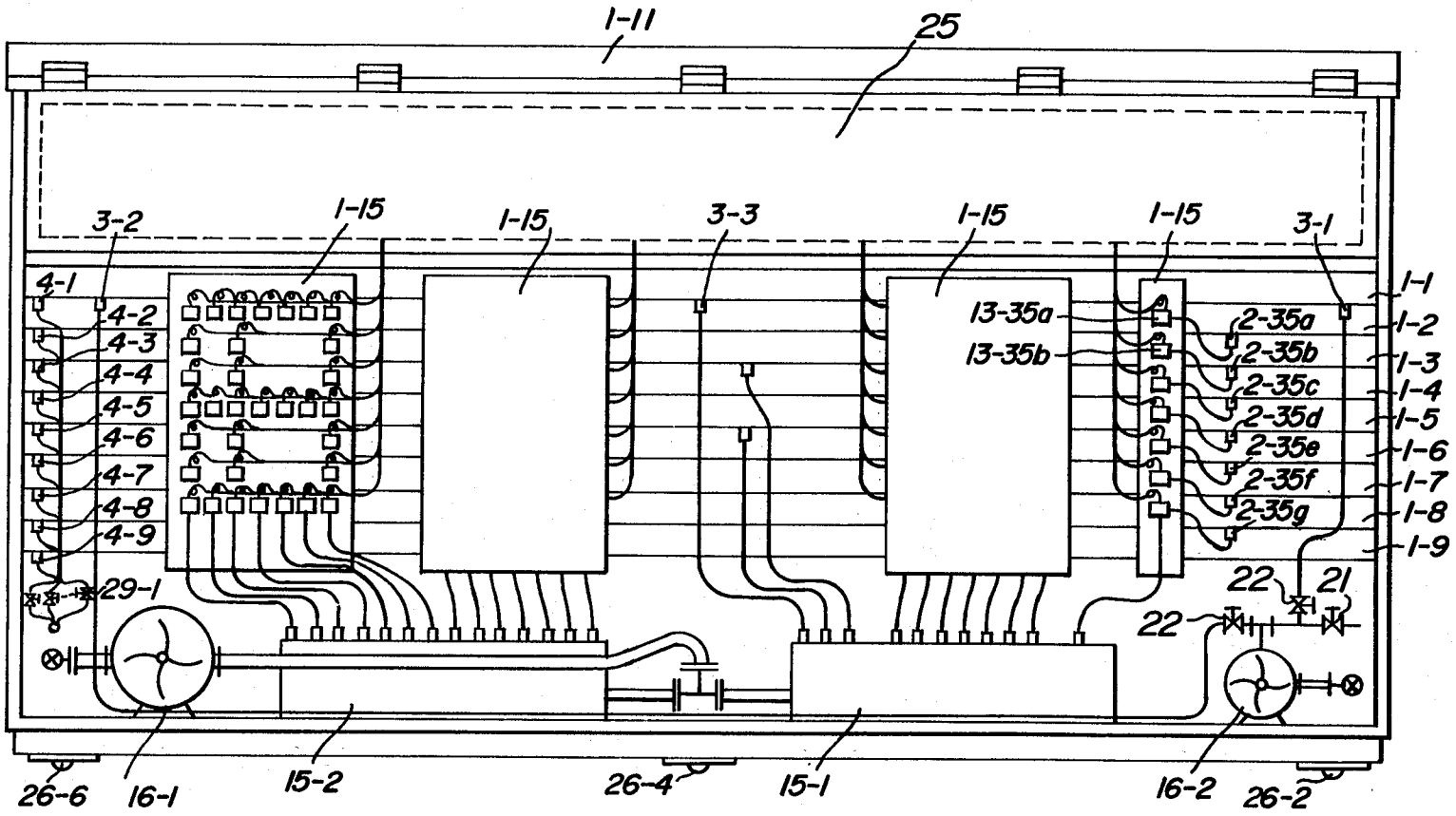
FIG. 5 is a back view of the same.

FIG. 5 is a rear view of the apparatus of the illustrated embodiment.

Water contained in the stepwise ponds 1-2, . . . 1-8 and that in the pond 1-1 may leak to the base pond 1-10 during non-operating time through display nozzles 2-1*a*, . . . 2-35*g*, electromagnetic valves 13-1*a*, . . . 13-35*g*, tanks 15-1 and 15-2, pump 16-1 and water supply nozzles 3-1 and 3-2, pump 16-2, respectively, or through water supply nozzle 3-3, tank 15-1 and pump 16-1. Also there will be a certain decrease of water by natural evaporation. If the pump 16-1 is operated to eject water from the display nozzles 2-1*a*, . . . 2-35*g*, at a time when there is no sufficient water in the stepwise ponds 1-2, . . . 1-8, there is danger in that not only the water fountain provide a suitable display of characters but the water jet may reach to the ceiling or splash out in the surroundings. In order to prevent occurence of such a situation, a safeguard circuit at the time of display is provided for operating the pump 16-2 prior to the time display operation to fill up the water in the stepwise ponds 1—1, . . . 1-9 at first through water supply nozzles 3-1 and 3-2 and thereafter the pump 16-1 is started by a clock display operation instruction from the electric control device 25. The pump 16-2 has a function of a drain pump besides the abovementioned supply pump. In the drain operation the pump 16-2 is operated by closing hand valve 22 and not feeding through supply nozzles 3-1 and 3-2 and the hand valve 21 is opened and coupled with a plastic drain hose to an available drainage. By the provision of the pump 16-2, there is no need of provision of a fixed drain pipe and this will afford a great advantage of the apparatus to make it portable as one of big features thereof. The apparatus can very easily be moved to any desired location by the above construction.

However, if the apparatus need not be moved, a fixed supply drain hose may be provided.

Drain of the stepwise ponds 1-1, . . . 1-9 is coupled from respective drain holes 4-1, . . . 4-9 to hand valves 29-1, . . . 29-9 and coupled to the base pond 1-10 therefrom. By opening the hand valves 29-1, . . . 29-9, water in the stepwise ponds 1-1, . . . 1-9 flows to the base pond 1-10. The water in the base pond 1-10 may be quickly drained by operating the pump 16-2.

Figure 6:
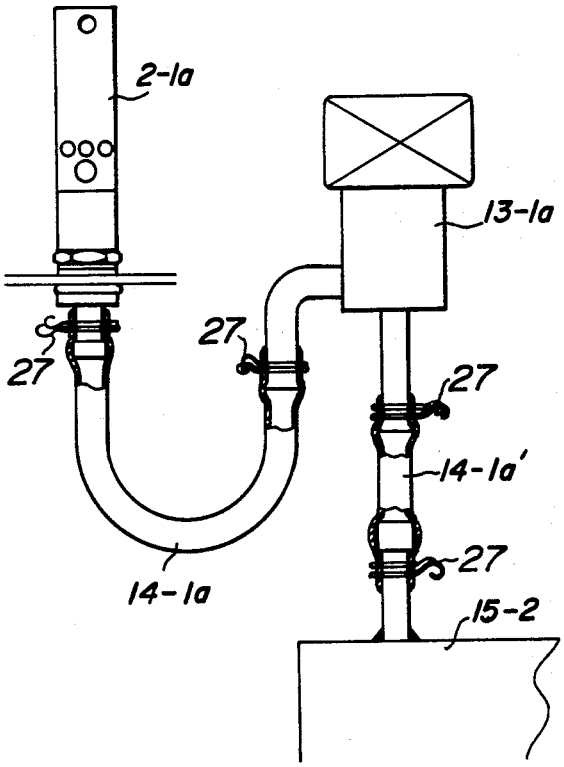
FIG. 6 is a diagram of an electromagnetic valve.

As a preferred embodiment, the piping arrangement between the display nozzles 2-1*a*, . . . 2-35*g* and electromagnetic valves 13-1*a*, . . . 13-35*g*, and between the valves 13-1*a*, . . . 13-35*g* and tank 15-1 and 15-2 is made by a plastic hoses 14-1*a* and 14-1*a'* and a clamping spring 27 as illustrated in FIG. 6. Other piping of the apparatus is carried in the same manner. The embodiment is shown as a preferred sample for saving the cost and easiness for assembly and the invention is not limited thereto.

Various practices may be used depending on the object of the provision of the apparatus and condition of the installing site so that PVC pipe, lead pipe, copper pipe, steel pipe or the like may be used besides the plastic hose. This may be a matter of design by those skilled in the art. The tanks 15-1 and 15-2 are made of steel but other material may be used. The pumps 16-1 and 16-2 are normal type but submerged type may be used to install in the base pond. Also not only one display pump 16-1 but 2, 3 or more of the pumps may be used to provide display fountain, but the detailed description is omitted since such can easily be considered.

Figure 7:
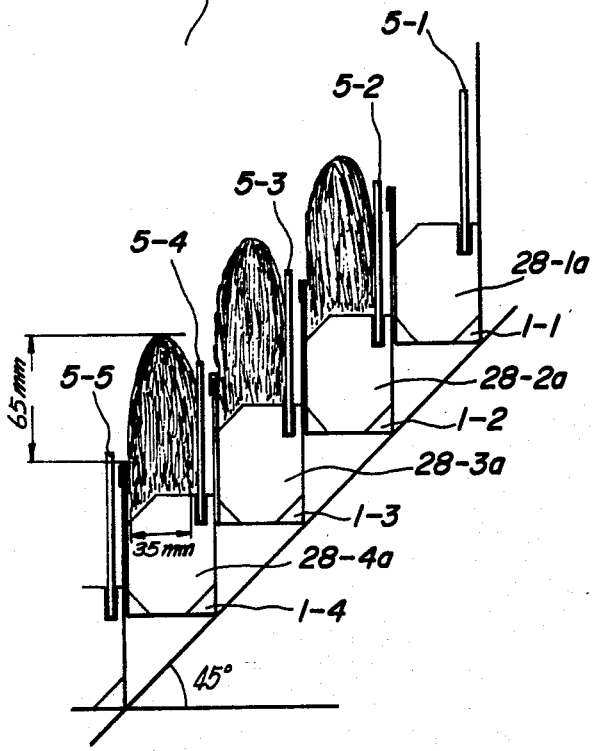
FIG. 7 shows side elevation of a stepwise pond showing its slope.

The inclined angle of the stepwise ponds 1-1, . . . 1-9 may suitably be selected to meet the kind of display nozzles 2-1*a*, . . . 2-35*g* used for the fountain display, size and style of the ejected water fountain and the condition of the site to be installed. One embodiment as shown in FIG. 7, in which the size of one water jet is 35 mm in diameter and 65 mm in height, and the inclined angle is 45°. This slanting or inclined angle of 45° is suitable from many view points, for instance, easy and cheap manufacture of the frame 1. This angle is selected only from the easiness of manufacture and is very easily modified to meet the condition of the site to be installed and may be selected 40°, 50° or 60° or so at will.

Figure 8:
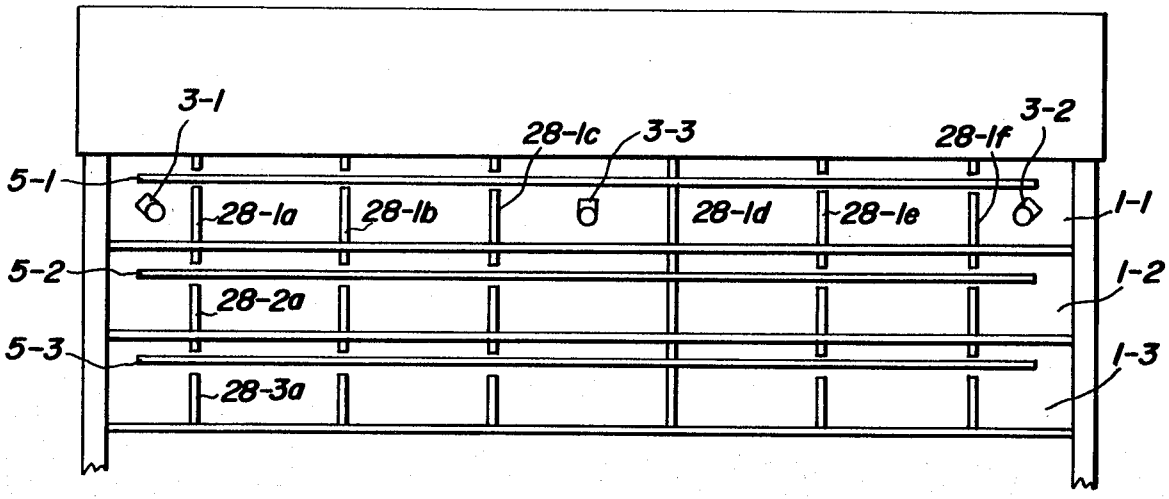
FIG. 8 is an enlarged plan view.

As shown in FIGS. 7 and 8, ripple preventing plates 5-1, . . . 5-9 having shorter length than the lateral width of the stepwise ponds 1-1, . . . 1-9 are provided for each of pond. These plates are arranged to extend slightly higher than the water level of immediate upper pond, for instance as shown in FIG. 7, the ripple preventing plate 5-2 of the stepwise pond 1-2 slightly extends over the water level of the immediate upper pond 1-1 and extends below the water level of the stepwise pond 1-2.

The ripple preventing plates 5-1, . . . 5-9 provided as mentioned as above prevent ripple or bubble by the falling water from the upper pond so as to avoid distortion of display fountain pattern and they have great advantage to prevent production of foams and bubbles at the water surface and also to remove foams and bubbles therefrom.

In addition to the water ejected from the display nozzle pattern, water may be supplied from feeding nozzle 3—3 at the same time of operation of the pump 16-1 to the stepwise pond 1-1 and let the water flow down from the pond 1-1 to immediate lower stepwise ponds, the abovementioned effect can be increased further.

The ripple preventing plates 5-1, . . . 5-9 are supported by inserting them into vertically cut slots provided in supporting plates 28-1*a*, . . . 29-9*c*. The supporting plates 28-1*d*, 28-2*d*, 28-3*d*, 28-4*d* . . . 28-9*d* located at center of the stepwise ponds 1-1, . . . 1-9 are arranged to have slots having corresponding width with the ripple preventing plates 5-1, . . . 5-9. The other supporting plates 28-1*a*, 28-1*b*, 28-1*c*, 28-1*e*, 28-1*f*, 28-2*a*, 28-9*e*, 28-9*f* are made to have a larger slot width than the thickness of the plates. By this arrangement occurence of strain in the plates by the thermal expansion and contraction of the ripple preventing plates 5-1, . . . 5-9 can be avoided.

In one embodiment black colored acryl plates have been used for the ripple preventing plates 5-1, . . . 5-9. The ripple preventing plates have mainly an ornamental function and are considered as a kind of accessory so that various colored plates or various kinds of plates may be used in order to meet color mathcing condition when the water is colored and other conditions without spoiling the primary object of the ripple preventing plates 5-1, . . . 5-9. This matter can be achieved easily so that a further explanation is omitted.

Figure 9:
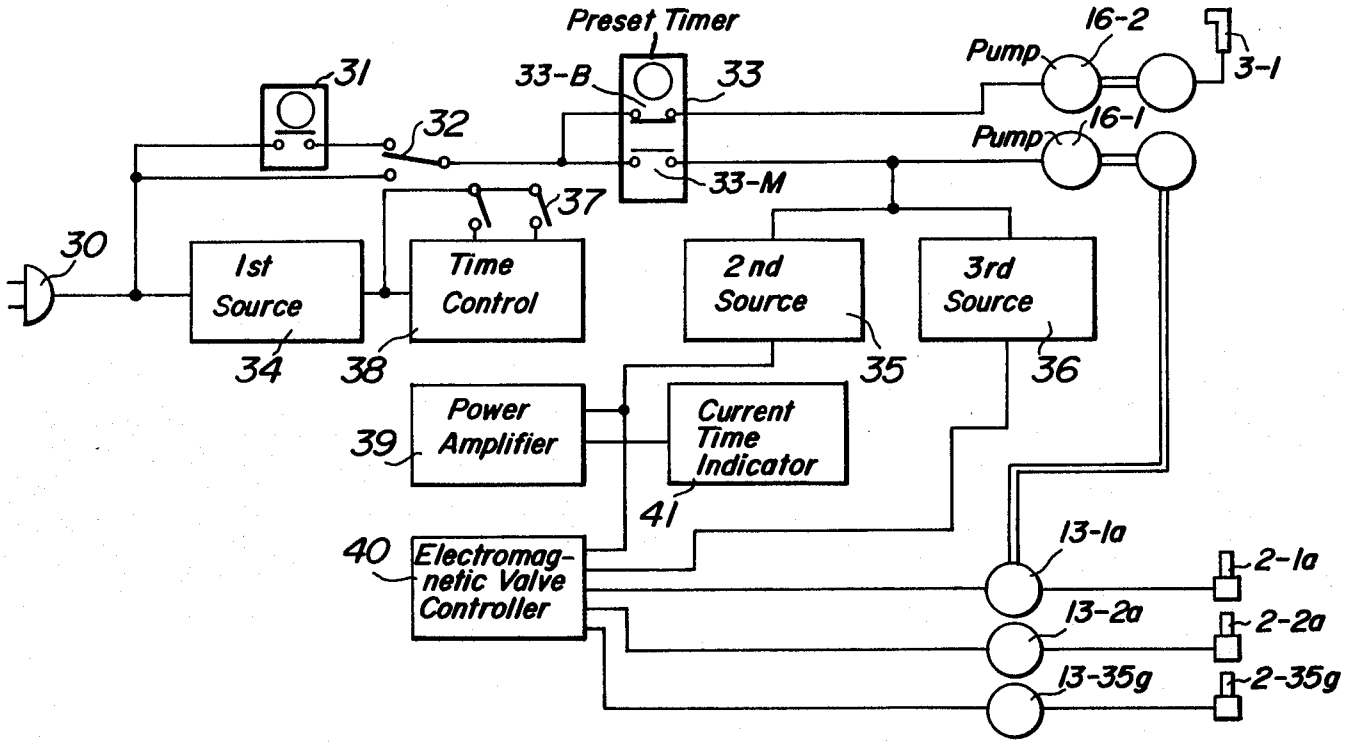
FIG. 9 is a circuit diagram of an electric control circuit of the apparatus.

Hereinafter, the electric control device as shown in FIG. 9 will be explained.

Supply coupling plug 30 is connected to an electrical supply source, for instance AC 100V, 50Hz or 60Hz, so as to supply source current and by this current a 24 hour timer 31 is energized. The 24 hour timer is used to control to set the operation time of the apparatus for instance 10:00 to 21:00.

A switch 32 is used to switch either to an automatic operation by the 24 hour timer 31 or to a manual operation connecting directly to the source terminal and switching off the 24 hour timer. The source current selected by the switch 32 is delivered to a preset timer 33 controlling water supplying time. The current supplied to the preset timer 33 at first energizes a motor pump 16-2 through a B-contact 33-B thereof. The pump 16-2 supplies water to fill up the stepwise ponds 1-1, . . . 1-9 through the water supply nozzles 3-1 and 3-2. The above time required to fill up the stepwise ponds 1-1, . . . 1-9 is previously set in the preset timer 33. After the lapse of the setting time, an M-contact 33-M of the preset timer 33 operates to deenergize the motor pump 16-2 and to start a motor pump 16-1. At the same time a 2nd internal supply device 35 and a 3rd internal supply device 36 start to operate. The 2nd supply device 35 is to supply an IC power amplifier 39 and the 3rd supply device 36 is to supply an IC electromagnetic valve controller 40.

From the supply source through the source plug 30, a current is fed to a 1st internal supply source 34, which in turn normally supplies an IC time controlling circuit 38. The circuit 38 is formed from an LSI and operates to deliver an exact time signal as a form of digital signal at each 1 minute, 10 minute, 1 hour and 10 hour by an internally housed crystal oscillator or by synchronization to the source frequency supplied through the source plug 30 of 50Hz or 60Hz.

The output signal of the IC time controlling circuit 38 is supplied to the power amplifier 39 and is provided with power amplification. The amplified output from the amplifier 39 is on one hand used to operate current time indicator 41 and on the other hand used to operate the electromagnetic valve controlling circuit 40.

The current time indicator 41 is a device for indicating the current time contained in the IC time controlling circuit 38. By checking the indicated time of the current time indicator 41, the IC time controlling circuit 38 can be adjusted to standard time of the moment by advancing or putting back it by using a time adjusting switch 37. Once the device is set to the current time, almost exact current time control signal can be obtained since the device can easily be adjusted at a very small error if the current supply through the source plug 30 is not stopped.

Another output signal of the IC current amplifier 39 is supplied to the electromagnetic valve controller 40 for energizing the electromagnetic valves 13-1*a*, . . . 13-35*g*, corresponding to display nozzles 2-1*a*, . . . 2-35*g* forming the display water pattern.

By the operation of the electromagnetic valves 13-1*a*, . . . 13-35*g* controlled by the electromagnetic valve controller 40, the current time which is the same as that shown in the current time indicator 41 is displayed by the water fountain selectively ejected through the display nozzles 2-1*a*, . . . 2-35*g*.

In the electric control circuit of the present embodiment IC circuits are used but other elements such as, for instance, transistors and other semiconductors, relays and other may easily be used to form an equivalent circuit so that further explanation is omitted. The display portion and the housing for the electric control equipment can be arranged separately if desired.

Figure 10:
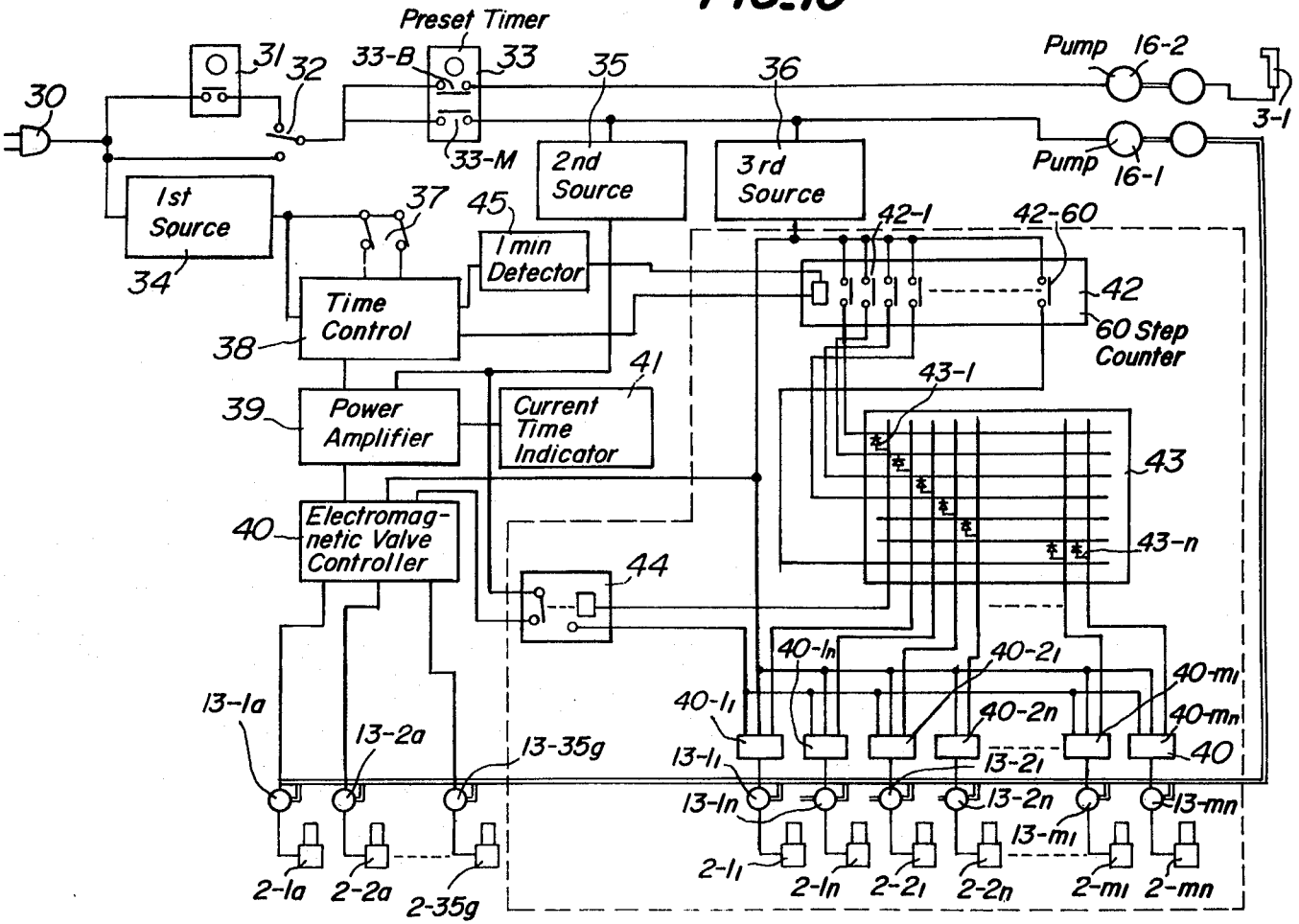
FIG. 10 is a circuit diagram for a modified embodiment for the character display.

In the foregoing explanation, the apparatus has been explained for indicating the current time, however, it can also be controlled to operate to display other characters together with the current time by adding a circuit encircled by the dotted line in FIG. 10 and display nozzles 2-1$_1$, . . . 2-1*n*, 2-2$_1$, . . . 2-2*n*, 2*m*$_1$, . . . 2*mn* and electromagnetic valves 13-1$_1$, . . . 13-1*n*, 13-2$_1$, . . . 13-2*n*, 13-*m*$_1$, . . . 13-*mn*.

As an example, Roman letters "WELCOME" can be displayed in an order of "W", "WE", "WEL", "WELC", "WELCO", "WELCOM" and "WELCOME" and then the characters are turned off and thereafter the current time may be displayed in the place.

By alternately displaying letters and current time, a more variation of display my be obtained. The letters or characters may be chosen to be a tradename or a company's name so as to realize a novel media of advertisement. Then the apparatus is used not only for an ornamental water fountain indicating the time but it can be used as a media of advertisement.

The illustrated embodiment shown in FIG. 10 may be explained briefly.

A 60 step counter 42 formed as a rotary relay responds to 1 second signal sent from the IC time controlling circuit 38 to successively hold its 60 contacts 42-1, . . . 42-60 in such turn. A 1-minute detector 45 is provided which is a circuit to deliver a signal at each step of minute, for example, when the time changes from 10:15 to 10:16. By this detector 45 the 60 step counter 42 is reset whenever it makes miscount at the time of 1-minute signal to return the contact to the initial point 42-1.

A program matrix 43 formed as a diode matrix circuit is arranged to couple to the output of the counter 42. This program matrix 43 is a circuit to make program whether the time is indicated or the characters or letters are displayed.

A switching relay 44 is provided to switch the current of the internal source 35 to the electromagnetic valve controller 40 for indicating the time or to electromagnetic vavle controller circuits 40-1$_1$, . . . 40-1*n*, 40-2$_1$, . . . 40-2*n*, . . . 40-*m*$_1$, . . . 40-*mn* for indicating letters.

When a word "WELCOME" is to be indicated, the electromagnetic valve controllers 40-1$_1$, . . . 40-1*n* responds to energize electromagnetic valves 13-1$_1$, . . . 13-1*n* for displaying one character "W" corresponding to the required nozzles 2-1$_1$, . . . 2-1*n*. Also the electromagnetic valves 20-2$_1$, . . . 40-2*n* energize electromagnetic valves 13-2$_1$, . . . 13-2*n* corresponding to the nozzles 2-2$_1$, . . . 2-2*n* for displaying character "E". In the same manner, the last character "E" is displayed by the circuits 40-M$_1$, . . . 40-M*n* for operating nozzles 2-M$_1$, . . . 2-M*n*.

One side of the lateral contacts in the 60 step counter 42 are connected to the internal source 36. On the other side, the contacts are connected to horizontal side of the program matrix 43. When the contacts are held in an order of 42-1 to 42-60, vertical circuits of the program matrix 43 connected to diodes 43-1, . . . 43-M may be fed from the internal source 36 so that the electromagnetic valve controller 40-1$_1$, . . . 40-1*n*, 40-2$_1$, . . . 40-2*n*, . . . 40-M$_1$, . . . 40-M*n* connected to the vertical circuits operate and the corresponding valves 13-1$_1$, . . . 13-1*n*, 13-2$_1$, . . . 13-2*n*, . . . 13-M$_1$, . . . 13-M*n* operate and the corresponding nozzles 2-1$_1$, . . . 2-1*n*, 2-2$_1$, . . . 2-2*n*, . . . 2-M$_1$, . . . 2-M*n* display the desired characters.

In the same manner, by the control of the vertical circuit of the program matrix 43, the switching relay 44 may be energized to change the character display to clock display.

As explained in this embodiment, the electromagnetic valves are separately set for clock display and character display, however, the valves and nozzles can be used in common for both display purposes.

Although not illustrated in the drawings, a plate may be arranged obliquely over the whole surface of the stepwise ponds 1-1, . . . 1-9 and somewhat larger holes are provided at locations of nozzles, a further advantage may be obtained by screening off foams, bubbles or the like. The apparatus may be installed at any desired location alone, but a more decoration effect may be expected by arranging small trees or flowers or the like in the surroundings. The apparatus may also be installed integrally in the wall surface of a building or in the bank of a garden and many other suitable arrangement can be considered.

By simply changing the bubble preventing plate, the color of the apparatus can easily be changed better to meet the surrounding atmosphere.

What is claimed is:

1. A unit type portable water fountain display apparatus comprising in combination:

a base pond, stepwise ponds stacked over the base pond stepwisely to form a generally slanting display plane, display nozzles arranged in desired location within the stepwise ponds and submerged below the water level of the respective pond when water is filled in the ponds to form desired display patterns, electromagnetic valves coupled to the respective display nozzles and to a pressured water tank to eject water jet through respective nozzle when controlled to operate, and an electric control means to control the electromagnetic valves to form desired display patterns to indicate information such as time, characters and the like, wherein the electric control means is provided with a function to fill up the water in the stepwise ponds prior to the operation of the electromagnetic valves to provide display through the nozzles.

2. A unit type portable water fountain display apparatus as claimed in claim 1, wherein the electric control means is a time control means which operates at first at the time of operation of the apparatus to fill up the water in the stepwise ponds in order to prevent the splash out of the fountain.

3. A unit type portable water fountain display apparatus as claimed in claim 1, wherein each step of the stepwise ponds has ripple preventing plates.

4. A unit type portable water fountain display apparatus as claimed in claim 3, wherein the ripple preventing plate extends upwardly slightly over the water level of the immediate adjacent upper pond and downwardly below the water level of its own pond.

5. A unit type portable water fountain display apparatus as claimed in claim 4, including supporting plates for said ripple plates, said supporting plates having vertically cut slots for receiving said ripple plates.

6. A unit type portable water fountain display apparatus as claimed in claim 4, wherein said ripple preventing plates are formed of acrylic resin.

7. A unit type portable water fountain display apparatus as claimed in claim 1, wherein the slanting display surface has the slanting angle about 30°–70° and more especially 45°.

* * * * *